US005938477A

United States Patent [19]

Yen

[11] Patent Number: 5,938,477

[45] Date of Patent: Aug. 17, 1999

[54] PLUG STRUCTURE FOR USE IN MINIATURE LIGHT BULB SERIES

[76] Inventor: Chun Chang Yen, No. 8, Lane 247, Nue Pu Rd., Hsinchu City, Taiwan

[21] Appl. No.: 09/006,461

[22] Filed: Jan. 13, 1998

[51] Int. Cl.[6] ..... H01R 13/68

[52] U.S. Cl. ..... 439/622; 439/459; 439/694; 439/934

[58] Field of Search ..... 439/622, 694, 439/459, 934

[56] References Cited

U.S. PATENT DOCUMENTS 3,609,630 9/1971 Francis ..... 439/694

5,249,986 10/1993 Lu ..... 439/622

5,482,478 1/1996 Liao ..... 439/622

*Primary Examiner*—Steven L. Stephan

*Assistant Examiner*—Javaid Nasri

*Attorney, Agent, or Firm*—Rosenberg, Klein & Bilker

[57] ABSTRACT

This invention relates to a plug structure for use in miniature light bulb series, which comprises a plug body provided with conductor blades, fuses, and a cover and associated with an end cap on one end. It makes use of an insertion association between separated conductor connectors and terminals and held by a locating plate to form a serial connection type plug. With such arrangement, the plug according to the invention can be made as an independent part for further assembling, avoiding tangling with electrical wires during delivery.

2 Claims, 5 Drawing Sheets

PLUG STRUCTURE FOR USE IN MINIATURE LIGHT BULB SERIES

BACKGROUND OF THE INVENTION

The plug used for a miniature light bulb series typically includes a plug body with two extended conductor wires. These conductor wires extend from the interior of the plug body and are connected to sockets and light bulbs to form a decorative light bulb series. As disclosed in U.S. Pat. Nos. 4,684,914; 5,154,642; and 5,320,563, such conventional structures make it necessary that the terminals of conductor wires must be put into the interior of the plug to get in touch with conductor copper blades while the plug is assembled. However, in a practical production operation, the electrical wire supplier and the plug maker often are not the same. Even if some companies produce both, plugs and wires are scarcely made at the same site. As a consequence, the plug makers have to acquire conductor wires before the production starts and only plugs integrated with conductor wires can be delivered to downstream assemblers for further processing. This is inconvenient for the production of plugs. Moreover, the procedure of incorporating conductor wires with terminals into a plug is rather complex. It is desirable to have an improvement on the conventional plug structure.

In view of the above-mentioned problems, the primary object of the invention is to provide an improved plug structure in which the deficiency of a conventional plug is eliminated and that can be made as an independent part used for further assembling, without the necessity of combination with conductor wires in advance. Now the detailed structure and features of the invention will be described here with reference to accompanying drawings.

SUMMARY OF THE INVENTION

A plug structure is provided for use with a decorative light bulb series. The plug body of the plug structure includes conductor blades, fuses and a cover contained therein with an end cap formed on one end thereof. Two openings are formed in the plug body to receive a pair of conductor connectors. A drawable locating plate is mounted on the underside of the plug body to positionally fix conductor wires where the terminals are inserted into the conductor connectors for passage of electrical energy. Each of the conductor connectors have an extended sideways bent tab to allow contiguous contact with one end of a fuse.

BRIEF DESCRIPTION OF THE ACCOMPANYING DRAWINGS

FIG. 1 is a perspective exploded view showing an embodiment of a plug according to the invention.

FIG. 2 perspectively shows the plug of FIG. 1 from another view angle.

DETAILED DESCRIPTION OF PREFERRED EMBODIMENTS

Figure 1:
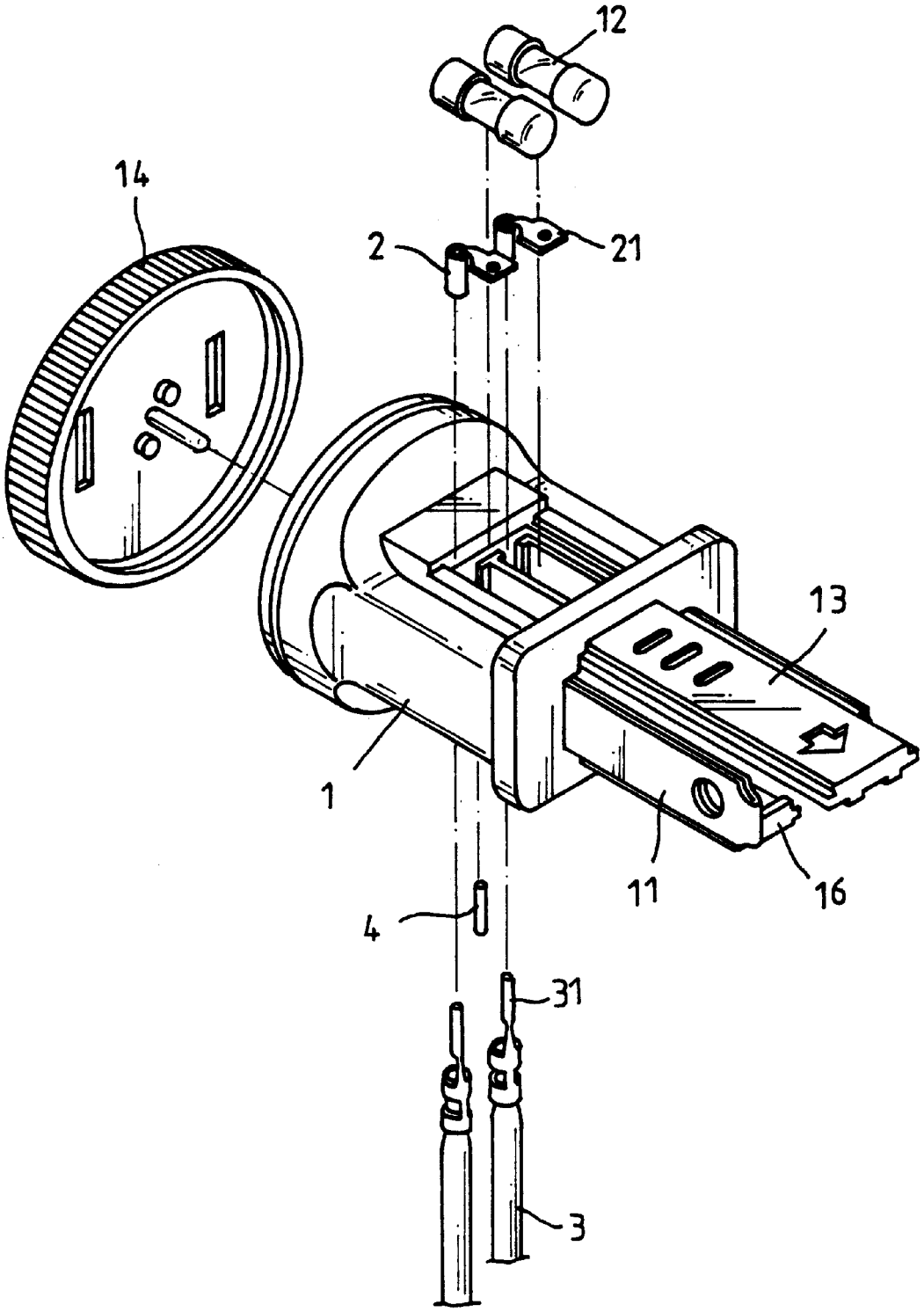
Figure 2:
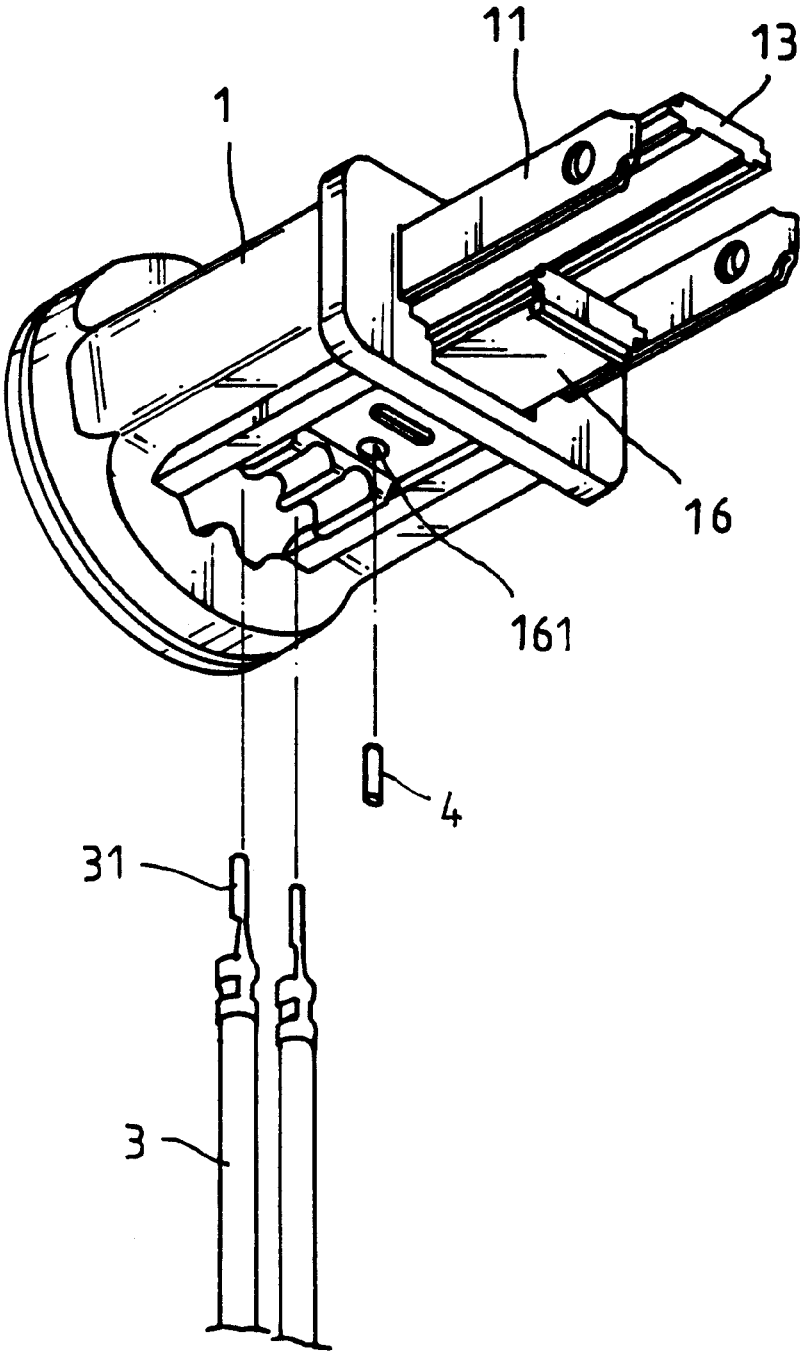
Figure 3:
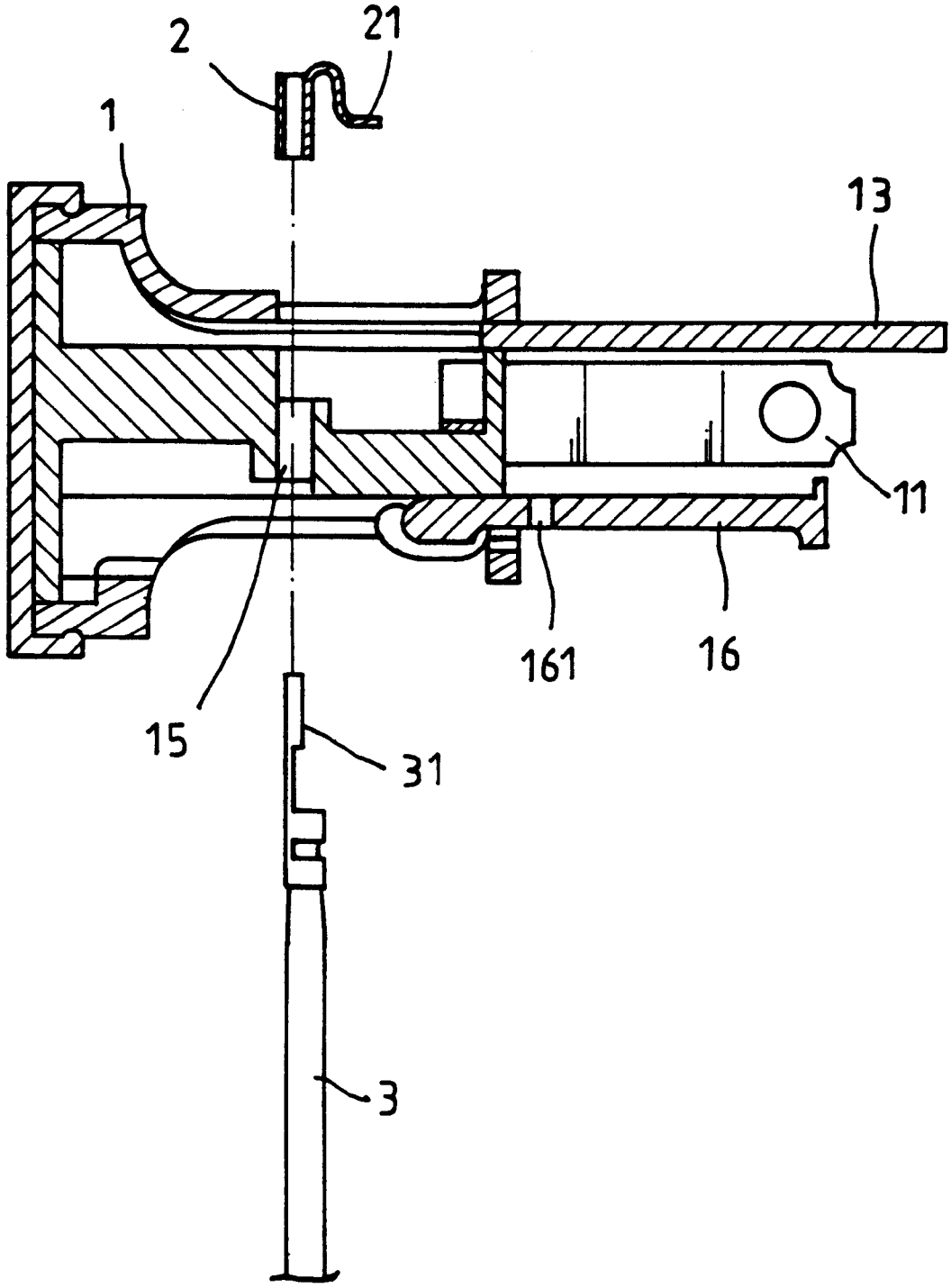
FIG. 3 is an exploded plan cross sectional view of the plug of FIG. 1.

Referring to FIGS. 1 through 3, the plug of the invention comprises a plug body (1) with conductor blades (11), fuses (12), and a cover (13) provided therein, and a cap (14) disposed on the rear end of the plug body. These parts are similar to those in a conventional plug structure and so they will not be further described here.

The plug according to the invention is featured by two openings (15) formed on the plug body (1) and a drawable locating plate (16) disposed on the underside of the plug body. The locating plate has a locating hole (161) and two conductor connectors (2) that have a hollow tubular body with a bent tab (21) formed on the top thereof. Two conductor connectors (2) can be individually inserted into two openings of the plug body (1), with two bent tabs sideways extending to get in touch with two ends of the fuse (12) respectively.

Figure 4:
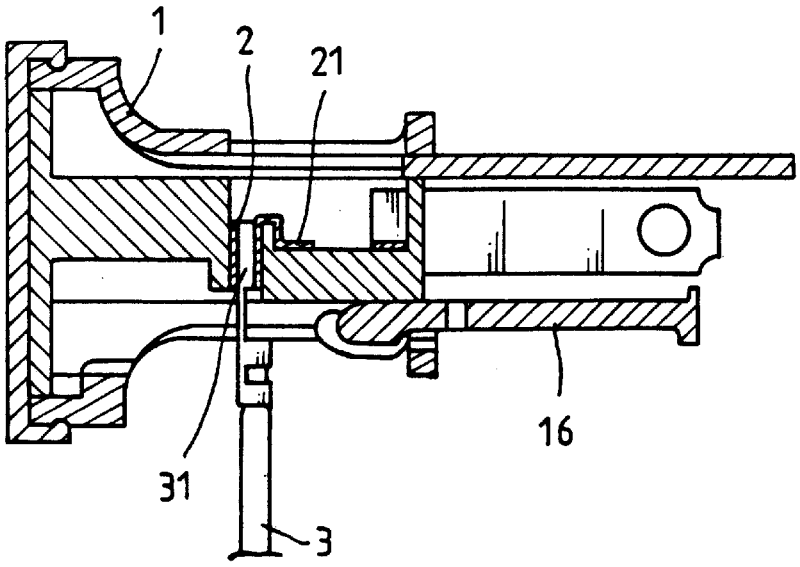
FIGS. 4 through 6 illustrate how electrical wires are assembled with a plug of the invention.
Figure 5:
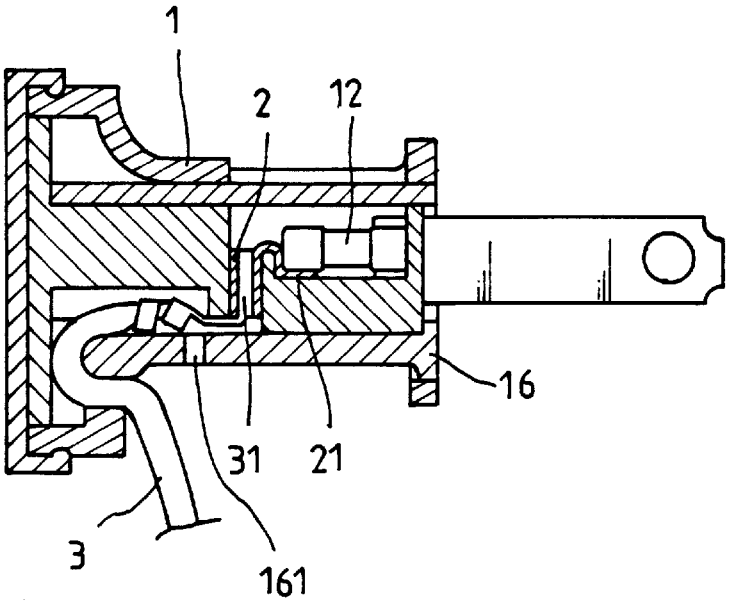
Figure 6:
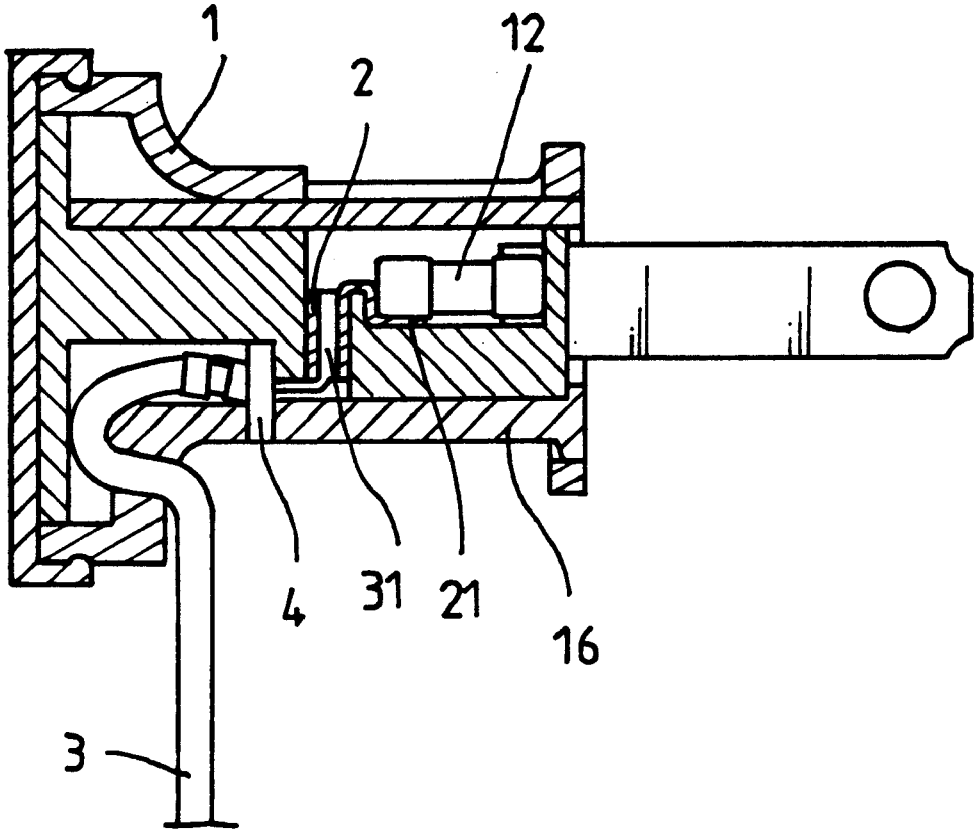

As shown in FIGS. 4 through 6, the plug of the invention is firmly connected with conductor wires (3) by inserting the terminals (31) of conductor wires (3) into the conductor connectors (2) and then pressing the conductor wires against the plug body by inwardly pushing the locating plate (16). A pin (4) passes through the locating hole (161) and is disposed between the terminals (31) of two conductor wires to separate them, avoiding accidental shorting.

From the above description, evidently the plug of the invention can be independently made and then delivered to downstream manufacturers for further assembling with conductor wires and light bulb series, without the necessity of combination with electrical wires in advance. The plug structure of the invention can facilitate the manufacturing of plugs and so it is useful for the industry.

What is claimed is:

1. A plug structure for use in decorative light bulb series, comprising a plug body provided with conductor blades, fuses, and a cover therein and associated with an end cap on one end, and characterized in that two openings are formed on said plug body for receiving two conductor connectors and that a drawable locating plate is arranged on the underside of the plug body to fix in position conductor wires of which the terminals are inserted into said conductor connectors to deliver electrical energy;

said two conductor connectors each having a bent tab sideway extending to get in touch with one end of said fuse.

2. A plug structure as claimed in claim 1, in which said locating plate is provided with a locating hole, passing through which a pin is disposed between said conductor wires to effectively separate them, keeping from shorting.

* * * * *